US005678427A

United States Patent [19]

Bonaquist et al.

[11] Patent Number: 5,678,427

[45] Date of Patent: Oct. 21, 1997

[54] CRYOGENIC RECTIFICATION SYSTEM FOR PRODUCING LOW PURITY OXYGEN AND HIGH PURITY NITROGEN

[75] Inventors: Dante Patrick Bonaquist, Grand Island; Susan Marie Sattan, Amherst, both of N.Y.

[73] Assignee: Praxair Technology, Inc., Danbury, Conn.

[21] Appl. No.: 671,053

[22] Filed: Jun. 27, 1996

[51] Int. Cl.[6] ..... F25J 3/04

[52] U.S. Cl. ..... 62/650; 62/654

[58] Field of Search ..... 62/645, 650, 651, 62/654

[56] References Cited

U.S. PATENT DOCUMENTS

| | | | |
|---|---|---|---|
| 3,210,951 | 10/1965 | Gaumer, Jr. . | |
| 4,704,148 | 11/1987 | Kleinberg . | |
| 4,705,548 | 11/1987 | Agrawal et al. | 62/645 |
| 4,769,055 | 9/1988 | Erickson . | |
| 4,796,431 | 1/1989 | Erickson . | |
| 5,006,139 | 4/1991 | Agrawal et al. | 62/650 X |
| 5,163,296 | 11/1992 | Ziemer et al. | 62/650 |
| 5,345,773 | 9/1994 | Nagamura et al. | 62/654 X |
| 5,392,609 | 2/1995 | Girault et al. . | |
| 5,396,773 | 3/1995 | Ha et al. | 62/654 X |
| 5,460,003 | 10/1995 | Nenov | 62/651 |
| 5,485,729 | 1/1996 | Higginbotham | 62/654 X |
| 5,551,258 | 9/1996 | Rathbone | 62/654 X |
| 5,582,031 | 12/1996 | Rathbone | 62/654 X |
| 5,600,970 | 2/1997 | Drnevich et al. | 62/654 X |
| 5,609,041 | 3/1997 | Rathbone et al. | 62/654 X |

*Primary Examiner*—Christopher Kilner
*Attorney, Agent, or Firm*—Stanley Ktorides

[57] ABSTRACT

A double column cryogenic rectification system for producing low purity oxygen and high purity nitrogen, preferably at elevated pressure, wherein nitrogen-rich vapor from the higher pressure column is turboexpanded and condensed against lower pressure column intermediate liquid prior to being passed into the lower pressure column.

10 Claims, 4 Drawing Sheets

CRYOGENIC RECTIFICATION SYSTEM FOR PRODUCING LOW PURITY OXYGEN AND HIGH PURITY NITROGEN

TECHNICAL FIELD

This invention relates generally to cryogenic rectification of air and, more particularly, to cryogenic rectification of feed air to produce oxygen and nitrogen. It is particularly useful for producing low purity oxygen and high purity nitrogen products at elevated pressures.

BACKGROUND ART

In some industrial applications it is desirable to use both low purity oxygen and high purity nitrogen. For example, in glassmaking, low purity oxygen is employed in oxy-fuel combustion to heat and melt the glassmaking materials while high purity nitrogen is used as an inerting atmosphere for the molten glass. Moreover, often the oxygen and the nitrogen are both required at elevated pressures.

Accordingly, it is an object of this invention to provide a cryogenic rectification system that can efficiently produce both low purity oxygen and high purity nitrogen.

It is another object of this invention to provide a cryogenic rectification system that can efficiently produce both low purity oxygen and high purity nitrogen at elevated pressure.

SUMMARY OF THE INVENTION

The above and other objects, that will become apparent to one skilled in the art upon a reading of this disclosure, are attained by the present invention, one aspect of which is:

A method for producing low purity oxygen and high purity nitrogen comprising:

(A) passing feed air into a higher pressure column and separating the feed air within the higher pressure column by cryogenic rectification into nitrogen-rich vapor and oxygen-enriched liquid;

(B) passing oxygen-enriched liquid into a lower pressure column;

(C) condensing a first portion of the nitrogen-rich vapor by indirect heat exchange with fluid from the bottom of the lower pressure column to produce first nitrogen-rich liquid, and passing first nitrogen-rich liquid into the lower pressure column;

(D) turboexpanding a second portion of the nitrogen-rich vapor and condensing the turboexpanded second portion by indirect heat exchange with fluid from above the bottom of the lower pressure column to produce second nitrogen-rich liquid, and passing second nitrogen-rich liquid into the lower pressure column;

(E) separating the fluids passed into the lower pressure column by cryogenic rectification into nitrogen-richer fluid and oxygen-richer fluid; and (F) recovering oxygen-richer fluid from the lower pressure column as product low purity oxygen and recovering nitrogen-containing fluid from at least one of the columns as product high purity nitrogen.

Another aspect of the invention is:

Apparatus for producing low purity oxygen and high purity nitrogen comprising:

(A) a first column, a second column and means for providing feed air into the first column;

(B) means for passing fluid from the lower portion of the first column into the second column;

(C) a bottom reboiler for the second column, means for passing fluid from the upper portion of the first column into said bottom reboiler, and means for passing fluid from said bottom reboiler into the second column;

(D) a turboexpander and means for passing fluid from the upper portion of the first column to the turboexpander;

(E) an intermediate heat exchanger for the second column, means for passing fluid from the turboexpander into the intermediate heat exchanger and means for passing fluid from the intermediate heat exchanger into the second column; and (F) means for recovering product low purity oxygen from the lower portion of the second column, and means for recovering product high purity nitrogen from the upper portion of at least one of the first and second columns.

As used herein, the term "tray" means a contacting stage, which is not necessarily as equilibrium stage, and may mean other contacting apparatus such as packing having a separation capability equivalent to one tray.

As used herein, the term "equilibrium stage" means a vapor-liquid contacting stage whereby the vapor and liquid leaving the stage are in mass transfer equilibrium, e.g. a tray having 100 percent efficiency or a packing element height equivalent to one theoretical plate (HETP).

As used herein the term "feed air" means a mixture comprising primarily oxygen and nitrogen, such as ambient air.

As used herein the term "low purity oxygen" means a fluid having an oxygen concentration within the range of from 50 to 98.5 mole percent.

As used herein, the term "high purity nitrogen" means a fluid having an nitrogen concentration greater than 98.5 mole percent.

As used herein, the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process*. The term, double column is used to mean a higher pressure column having its upper end in heat exchange relation with the lower end of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or low boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangement that utilize the principles of rectification to separate mixtures are often interchangeably termed rectification columns, distillation or columns, or fractionation column. Cryogenic rectification is a rectification process carried out at least in part at temperatures at or below 150 degrees Kelvin (K).

As used herein, the term "indirect heat exchange" means the bringing of two fluid streams into heat exchange relation without any physical contact or intermixing of the fluids with each other.

As used herein the term "reboiler" means a heat exchange device that generates column upflow vapor from column liquid.

As used herein, the terms "turboexpansion" and "turboexpander" mean respectively method and apparatus for the flow of high pressure gas through a turbine to reduce the pressure and the temperature of the gas thereby generating refrigeration.

As used herein, the terms "upper portion" and "lower portion" mean those sections of a column respectively above and below the mid point of the column.

As used herein, the term "bottom" when referring to a column means that section of the column below the column mass transfer internals, i.e. trays or packing.

As used herein, the term "bottom reboiler" means a reboiler that boils liquid from the bottom of a column.

As used herein, the term "intermediate heat exchanger" means a reboiler that boils liquid from above the bottom of a column.

The numerals in the Figures are the same for the common elements.

DETAILED DESCRIPTION

The invention will be described in detail with reference to the Drawings.

Figure 1:
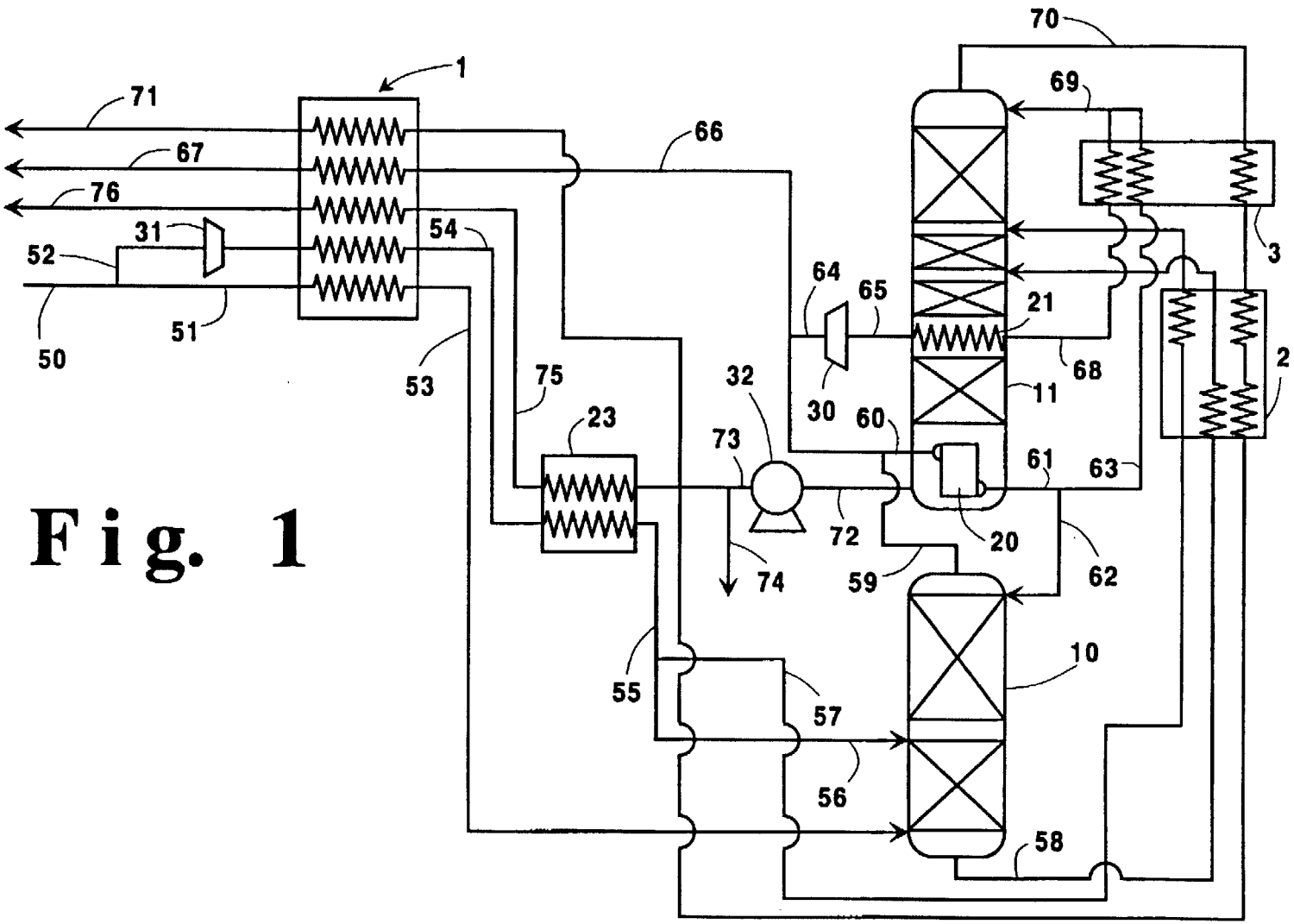
FIG. 1 is a schematic representation of one preferred embodiment of the invention.

Referring now to FIG. 1, feed air 50, which has been cleaned of high boiling impurities such as carbon dioxide and water vapor, is divided into main feed air portion 51 and boosted feed air portion 52. Boosted feed air portion 52 is compressed to a high pressure, generally within the range of from 60 to 500 pounds per square inch absolute (psia), by passage through compressor 31. The feed air portions are then passed through main heat exchanger 1 wherein they are cooled by indirect heat exchange with return streams. Resulting cooled main feed air portion 53 is passed into first or higher pressure column 10, that is operating at a pressure generally within the range of from 60 to 90 psia and that is part of a double column system that also comprises second or lower pressure column 11. If desired, a portion of the feed air may be turboexpanded and passed directly into lower pressure column 11. This generates additional refrigeration and enables the production of more liquid product.

Cooled boosted feed air portion 54 is passed from main heat exchanger 1 to product boiler 23 wherein it is condensed against vaporizing liquid low purity oxygen as will be more fully described below. Resulting condensed boosted feed air portion 55 is divided into portion 56, which is passed into higher pressure column 10, and into portion 57 which is subcooled by passage through subcooler 2 and then passed into lower pressure column 11.

Within first or higher pressure column 10 the feed air is separated by cryogenic rectification into nitrogen-rich vapor and oxygen-enriched liquid. Oxygen-enriched liquid, having an oxygen concentration generally within the range of from 30 to 40 mole percent, is withdrawn from the lower portion of higher pressure column 10 and passed in stream 58 through subcooler 2, wherein it is subcooled by indirect heat exchange with a return stream, and then into second or lower pressure column 11.

Nitrogen-rich vapor is withdrawn from the upper portion of higher pressure column 10 as stream 59. A first portion 60 of the nitrogen-rich vapor is passed into main condenser or bottom reboiler 20 wherein it is condensed by indirect heat exchange with boiling column 11 bottom liquid. Resulting nitrogen-rich liquid 61 is passed out of lower pressure column bottom reboiler 20. A portion 62 of liquid 61 is passed back into higher pressure column 10 as reflux. Another portion 63 of liquid 61 is subcooled by passage through subcooler 3 and then passed into the upper portion of lower pressure column 11.

A second portion 64 of the nitrogen-rich vapor is turboexpanded by passage through turboexpander 30 to generate refrigeration and the resulting turboexpanded stream 65 is passed into intermediate heat exchanger 21. Preferably a minor portion of turboexpanded stream 65, generally from about 1 to 12 percent, is liquid with the rest being vapor. Intermediate heat exchanger 21 may be physically within lower pressure column 11 or it may be physically outside lower pressure column 11. When intermediate heat exchanger 21 is physically within column 11 it is located above, generally from 5 to 30 equilibrium stages above, bottom reboiler 20 and below, generally from 5 to 30 equilibrium stages below, the point where oxygen-enriched liquid 58 is passed into column 11.

FIG. 1 illustrates a preferred embodiment of the invention wherein high purity nitrogen is recovered at an elevated pressure. In this embodiment a portion 66 of the nitrogen-rich vapor is passed from the upper portion of higher pressure column 10 and through main heat exchanger 1 wherein it is warmed by indirect heat exchange with the cooling feed air. Resulting elevated pressure nitrogen, generally at the pressure at which the higher pressure column is operating, is recovered as elevated pressure high purity nitrogen product in stream 67. Alternatively, some of turboexpanded stream 65 may be recovered as product high purity nitrogen. This increases the amount of nitrogen-rich vapor turboexpanded through turboexpander 30, increasing the amount of refrigeration generated and enabling a greater recovery of liquid product.

Turboexpanded nitrogen-rich vapor 65 is condensed in intermediate heat exchanger 21 by indirect heat exchange with fluid from above the bottom of the lower pressure column, and resulting nitrogen-rich liquid is passed from heat exchanger 21 in stream 68 through subcooler 3 and into lower pressure column 11. Preferably, as illustrated in FIG. 1, streams 68 and 63 are combined to form stream 69 which is then passed into lower pressure column 11.

Lower pressure column 11 is operating at a pressure lower than that of higher pressure column 10 and generally within the range of from 15 to 30 psia. Within lower pressure column 11 the various fluids passed into the column are separated by cryogenic rectification into nitrogen-richer fluid and oxygen-richer fluid. Nitrogen-richer fluid is withdrawn from the upper portion of lower pressure column 11 as vapor stream 70 which is warmed by passage through subcoolers 3 and 2 and main heat exchanger 1. Resulting stream 71 may be recovered as high purity nitrogen product.

Oxygen-richer fluid is withdrawn from the lower portion of lower pressure column 11 and recovered as product low purity oxygen. FIG. 1 illustrates a preferred embodiment of the invention wherein the product low purity oxygen is recovered at elevated pressure. In the embodiment illustrated in FIG. 1, oxygen-richer fluid is withdrawn from the lower portion of column 11 as liquid stream 72. Stream 72 is increased in pressure by passage through liquid pump 32 to a pressure generally within the range of from 25 to 350 psia to produce pressurized liquid stream 73. If desired, a portion 74 of stream 73 may be recovered as liquid low purity oxygen product. The pressurized liquid low purity oxygen in stream 73 is then passed into product boiler 23 wherein it is vaporized by indirect heat exchange with condensing feed air as was previously described. Resulting vaporized elevated pressure low purity oxygen stream 75 is then warmed by passage through main heat exchanger 1 against cooling feed air and resulting stream 76 is recovered as elevated pressure low purity oxygen product.

Figure 2:
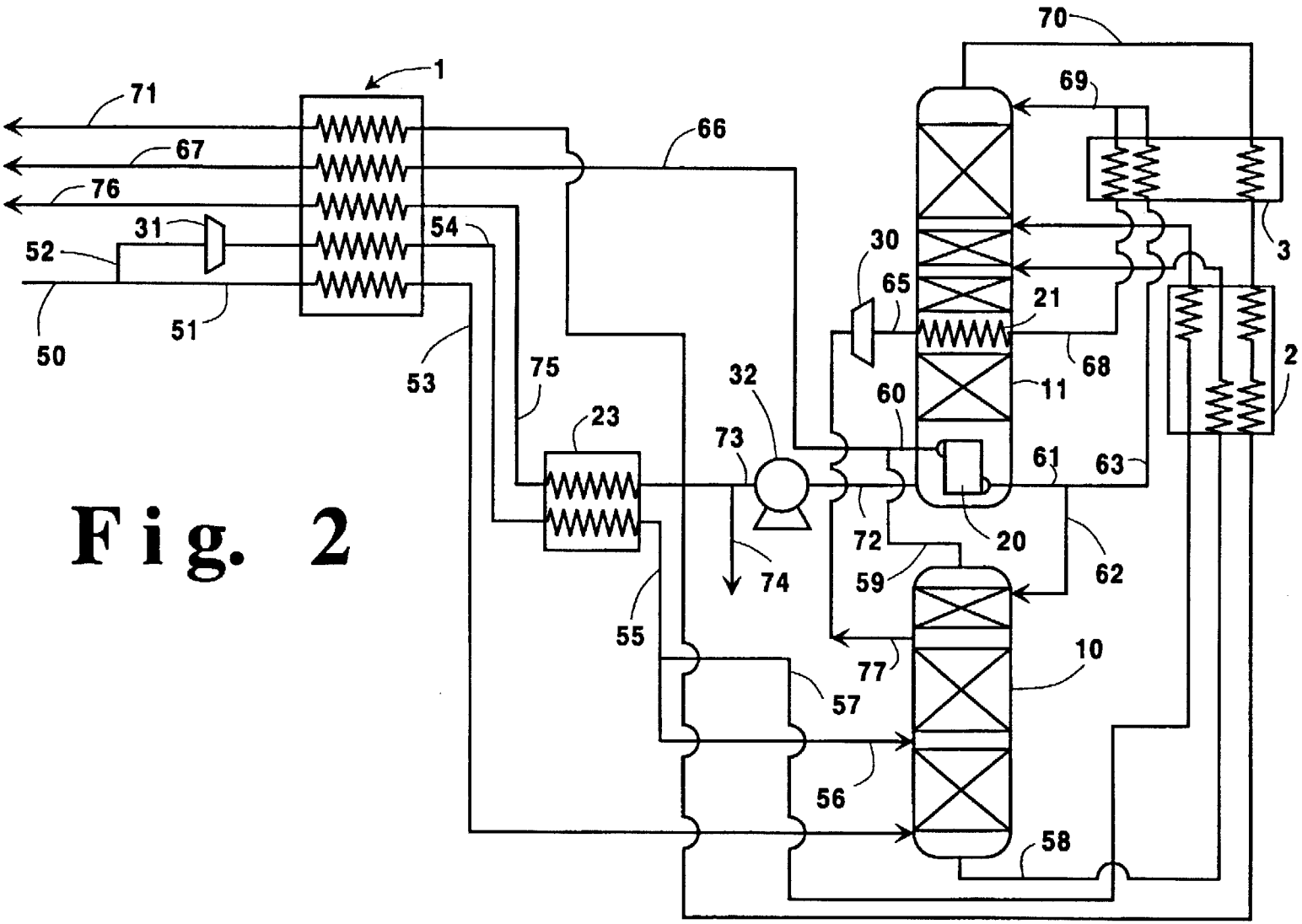
FIG. 2 is a schematic representation of another preferred embodiment of the invention wherein the nitrogen-rich vapor passed to the bottom reboiler and to the intermediate heat exchanger is taken from different points of the higher pressure column.
Figure 3:
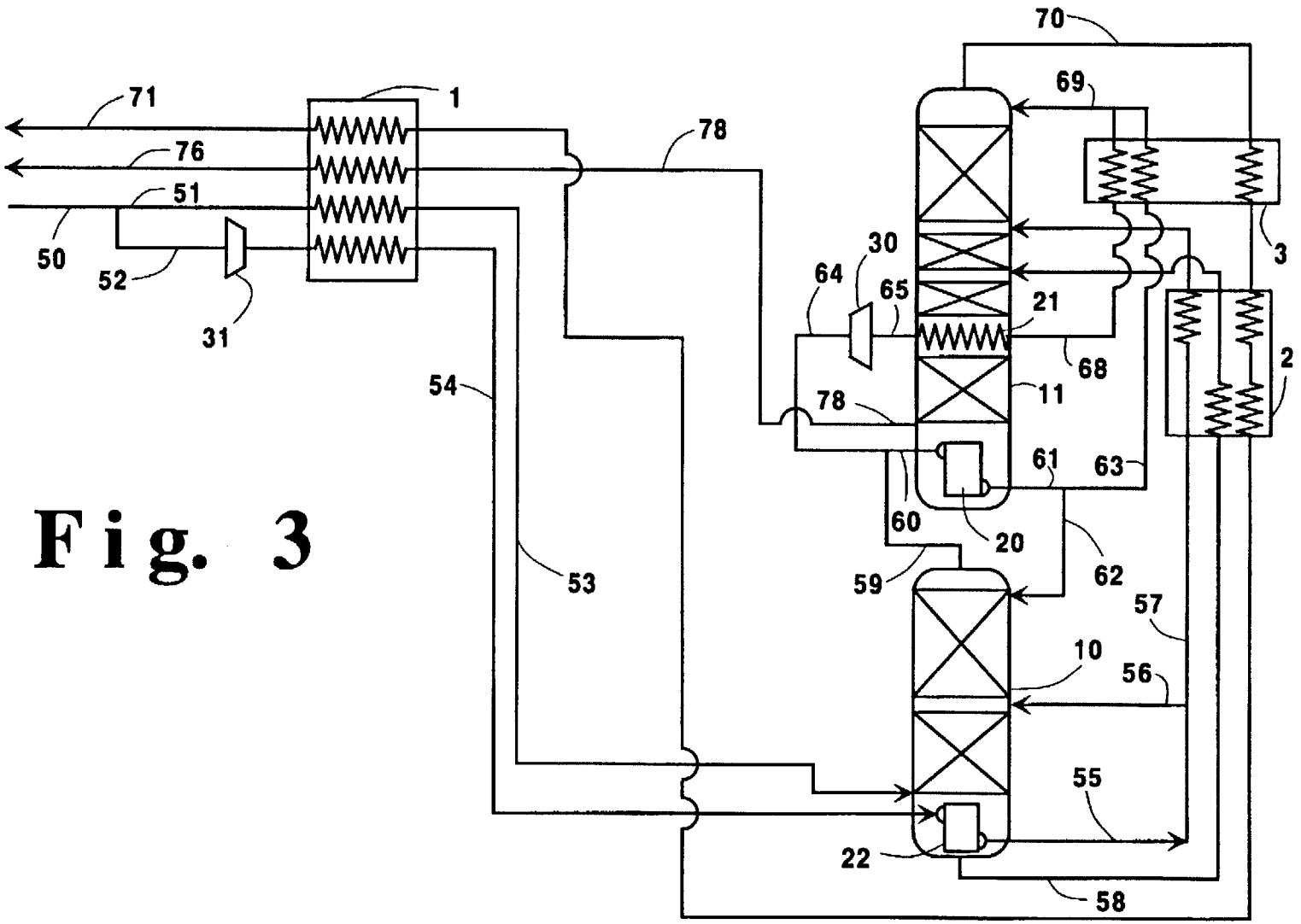
FIG. 3 is a schematic representation of another preferred embodiment of the invention wherein the higher pressure column also has a bottom reboiler.
Figure 4:
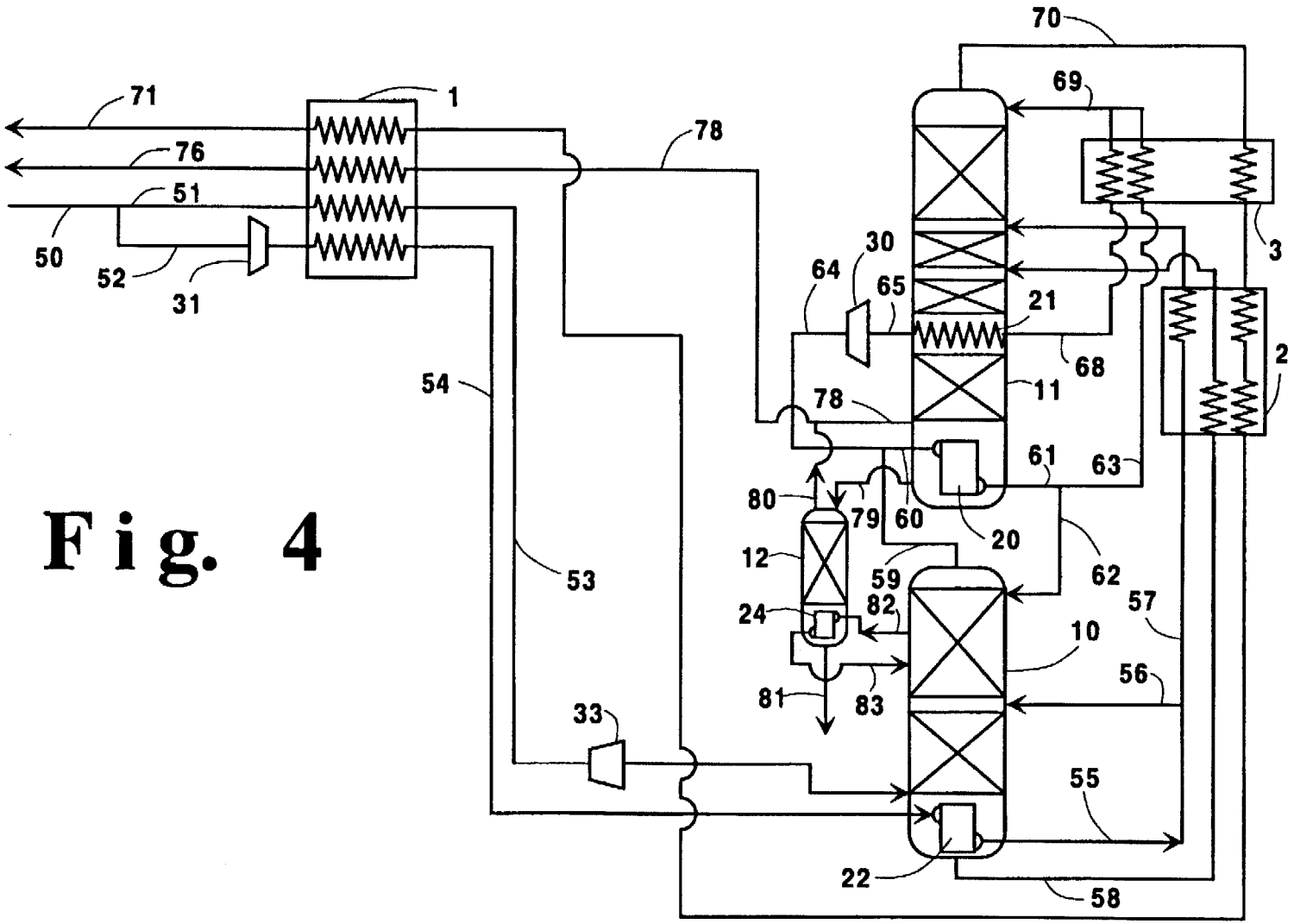
FIG. 4 is a schematic representation of yet another preferred embodiment of the invention wherein some high purity oxygen is additionally produced using an auxiliary column.

FIGS. 2, 3 and 4 illustrate other preferred embodiments of the invention. The common elements have the same numerals and will not be described again in detail.

In the embodiment illustrated in FIG. 2 the nitrogen-rich vapor passed to turboexpander 30 is taken in stream 77 from below the top of higher pressure column 10. This nitrogen-rich vapor in stream 77 contains a greater amount of impurities than does the nitrogen-rich vapor which is recovered as product in stream 67. Stream 77 is passed through turboexpander 30 and is processed as previously described. The embodiment illustrated in FIG. 2 is advantageous in some situations wherein only the portion of the nitrogen recovered as product needs to be purified to the product level.

The embodiment of the invention illustrated in FIG. 3 is particularly advantageous for the production of oxygen when the lower pressure column is operated substantially above atmospheric pressure, such as within the range of from 60 to 90 psia. In this embodiment, boosted feed air portion 54 is passed into bottom reboiler 22 of higher pressure column 10 wherein it is condensed by indirect heat exchange with oxygen-enriched liquid. Resulting condensed feed air stream 55 is processed as described above. Oxygen-richer fluid is withdrawn from the lower portion of lower pressure column 11 as vapor stream 78 which is then passed through main heat exchanger 1 and recovered as low purity oxygen product. The high purity nitrogen product is taken from the upper portion of lower pressure column 11.

The embodiment of the invention illustrated in FIG. 4 is similar to that illustrated in FIG. 3 with the addition of side column 12 that produces high purity oxygen having a purity exceeding 98.5 mole percent. In this embodiment, oxygen-richer liquid is passed in stream 79 from the bottom of lower pressure column 11 into the upper portion of side column 12 and is separated therein by cryogenic rectification into low purity oxygen vapor, that is withdrawn from the upper portion of column 12 in stream 80 and preferably added to stream 78, and into high purity oxygen liquid which is withdrawn from the lower portion of column 12 in stream 81 and recovered. Side column 12 is driven by bottom reboiler 24. Nitrogen-containing vapor 82 is passed from higher pressure column 10 into reboiler 24 wherein it is condensed by indirect heat exchange with boiling column 12 bottom liquid. Resulting nitrogen-containing liquid is passed from bottom reboiler 24 into high pressure column 11 in stream 83. If desired, in order to generate increased refrigeration, cooled main feed air portion 53 may be turboexpanded by passage through turboexpander 33 prior to being passed into higher pressure column 10.

Now with the use of this invention, one can efficiently produce low purity oxygen and high purity nitrogen, and both products can be produced at elevated pressure. The intermediate heat exchanger of the invention utilizes excess driving force available in the stripping section of the lower pressure column to provide refrigeration to sustain the cycle without jeopardizing the driving force in the upper rectifying section of the column. The refrigeration is produced by the turboexpansion of nitrogen-rich vapor from the higher pressure column. This refrigeration displaces refrigeration generally produced by conventional expansion of an elevated pressure feed air stream into an intermediate point in the lower pressure column. As a result, a substantial quantity of high purity nitrogen may be withdrawn from the column system and recovered at elevated pressure. This reduces capital requirements, reduces process irreversibility, and improves product recoveries for a given work input over that possible with conventional practice.

Although the invention has been described in detail with reference to certain preferred embodiments, those skilled in the art will recognize that there are other embodiments of the invention within the spirit and the scope of the claims.

We claim:

1. A method for producing low purity oxygen and high purity nitrogen comprising:

(A) passing feed air into a higher pressure column and separating the feed air within the higher pressure column by cryogenic rectification into nitrogen-rich vapor and oxygen-enriched liquid;

(B) passing oxygen-enriched liquid into a lower pressure column;

(C) condensing a first portion of the nitrogen-rich vapor by indirect heat exchange with fluid from the bottom of the lower pressure column to produce first nitrogen-rich liquid, and passing first nitrogen-rich liquid into the lower pressure column;

(D) turboexpanding a second portion of the nitrogen-rich vapor and condensing the turboexpanded second portion by indirect heat exchange with fluid from above the bottom of the lower pressure column to produce second nitrogen-rich liquid, and passing second nitrogen-rich liquid into the lower pressure column;

(E) separating the fluids passed into the lower pressure column by cryogenic rectification into nitrogen-richer fluid and oxygen-richer fluid; and (F) recovering oxygen-richer fluid from the lower pressure column as product low purity oxygen and recovering nitrogen-containing fluid from at least one of the columns as product high purity nitrogen.

2. The method of claim 1 wherein high purity nitrogen product is recovered from the higher pressure column.

3. The method of claim 1 wherein oxygen-richer fluid is withdrawn from the lower pressure column as liquid, increased in pressure and vaporized by indirect heat exchange with a feed air stream prior to recovery as product low purity oxygen.

4. The method of claim 1 further comprising condensing a feed air stream by indirect heat exchange with oxygen-enriched liquid and passing the resulting condensed feed air into at least one of the higher pressure column and the lower pressure column.

5. The method of claim 1 further comprising withdrawing oxygen-richer fluid from the lower pressure column as liquid, passing said oxygen-richer liquid into a side column, and separating the oxygen-richer liquid within the side column by cryogenic rectification to produce high purity oxygen.

6. Apparatus for producing low purity oxygen and high purity nitrogen comprising:

(A) a first column, a second column and means for providing feed air into the first column;

(B) means for passing fluid from the lower portion of the first column into the second column;

(C) a bottom reboiler for the second column, means for passing fluid from the upper portion of the first column into said bottom reboiler, and means for passing fluid from said bottom reboiler into the second column;

(D) a turboexpander and means for passing fluid from the upper portion of the first column to the turboexpander;

(E) an intermediate heat exchanger for the second column, means for passing fluid from the turboexpander into the intermediate heat exchanger and means for passing fluid from the intermediate heat exchanger into the second column; and (F) means for recovering product low purity oxygen from the lower portion of the second column, and means for recovering product high purity nitrogen from the upper portion of at least one of the first and second columns.

7. The apparatus of claim 6 wherein the means for recovering product high purity nitrogen communicates with the upper portion of the first column.

8. The apparatus of claim 6 wherein the means for recovering product low purity oxygen from the lower portion of the second column includes a liquid pump and a product boiler.

9. The apparatus of claim 6 further comprising a bottom reboiler for the first column, means for passing feed air into said bottom reboiler for the first column, and means for passing feed air from said bottom reboiler for the first column into at least one of the first and second columns.

10. The apparatus of claim 6 further comprising a side column, means for passing liquid from the lower portion of the second column into the upper portion of the side column, and means for recovering product from the lower portion of the side column.

* * * * *